US008978613B2

(12) United States Patent
Will

(10) Patent No.: US 8,978,613 B2
(45) Date of Patent: Mar. 17, 2015

(54) METHOD AND APPARATUS FOR OILING ROTATING OR OSCILLATING COMPONENTS

(75) Inventor: Frank Will, Jan Juc (AU)

(73) Assignee: INO8 Pty Ltd, Victoria (AU)

( * ) Notice: Subject to any disclaimer, the term of this patent is extended or adjusted under 35 U.S.C. 154(b) by 237 days.

(21) Appl. No.: 13/256,611

(22) PCT Filed: Mar. 19, 2010

(86) PCT No.: PCT/EP2010/053643

§ 371 (c)(1),
(2), (4) Date: Sep. 14, 2011

(87) PCT Pub. No.: WO2010/106179

PCT Pub. Date: Sep. 23, 2010

(65) Prior Publication Data

US 2012/0006622 A1 Jan. 12, 2012

(30) Foreign Application Priority Data

Mar. 19, 2009 (DE) ..... 10 2009 013 943

(51) Int. Cl.
*F01M 1/02* (2006.01)
*F01M 5/00* (2006.01)
(Continued)

(52) U.S. Cl.
CPC ..... *F01M 5/005* (2013.01); *F01M 11/02* (2013.01); *F02B 2075/027* (2013.01);
(Continued)

(58) Field of Classification Search
CPC ..... F01M 11/02; F01M 1/02; F01M 11/0004; F02B 2075/027; F02B 2075/025
USPC ..... 123/196 R
See application file for complete search history.

(56) References Cited

U.S. PATENT DOCUMENTS 4,249,491 A * 2/1981 Stein ..... 123/142.5 R
4,393,824 A 7/1983 Fischer et al.
(Continued)

FOREIGN PATENT DOCUMENTS

DE 2753716 6/1979
DE 19908088 A1 8/2000
(Continued)

OTHER PUBLICATIONS

International Search Report for corresponding International Application PCT/EP2010/053643.

*Primary Examiner* — Lindsay Low
*Assistant Examiner* — Charles Brauch
(74) *Attorney, Agent, or Firm* — WRB-IP LLP

(57) ABSTRACT

A method is provided for heating a lubricating system. At low temperatures, lubricating oil has a high viscosity which requires more energy to be overcome than at higher temperatures. The method speeds up the heating behavior and thereby reduces the energy requirement of lubricating systems. The method can be used to heat lubricating systems for combustion engines or transmissions, preferably automatic transmissions, including at least one oil suction tube which is disposed in an oil sump and an oil bypass line bypassing the oil return lines. A bypass valve is disposed in the oil bypass line. The oil bypass line and/or at least one of the oil return lines is connected to the suction line of an oil pump and the pressure line of a lubricating system and, during use, runs in a combustion engine, preferably through at least one cylinder head, a cylinder block, or a turbocharger, and during use in a transmission it preferably runs through at least one heat exchanger of the combustion engine and/or through at least one electrical heating element. When a defined limit temperature is no longer met and a defined minimum pressure of the lubricating oil in the pressure line of the lubricating system is exceeded, the bypass valve is opened at least partially, so that a partial flow of the lubricating oil does not flow through the oil sump during the warm-up phase of the lubricating system. The lubricating oil flowing through the oil bypass line and/or at least one of the oil return lines is heated by a heat exchanger. The method is particularly suited for quickly heating combustion engines and transmissions in motor vehicles.

30 Claims, 5 Drawing Sheets

(51) Int. Cl.

| | |
|---|---|
| ***F01M 5/02*** | (2006.01) |
| *F01M 11/02* | (2006.01) |
| *F02B 75/02* | (2006.01) |
| *F01M 11/00* | (2006.01) |

(52) U.S. Cl.

CPC ..... *F01M 1/02* (2013.01); *F02B 2075/025* (2013.01); *F01M 11/0004* (2013.01); *F01M 5/001* (2013.01); *F01M 5/002* (2013.01); *F01M 5/02* (2013.01)

USPC ..... 123/196 R

(56) References Cited

U.S. PATENT DOCUMENTS

| | | | | |
|---|---|---|---|---|
| 7,047,913 | B2 * | 5/2006 | Werner et al. | 123/41.33 |
| 2002/0005279 | A1 * | 1/2002 | Maute | 165/148 |
| 2009/0056317 | A1 * | 3/2009 | Sudmanns | 60/288 |
| 2009/0277173 | A1 * | 11/2009 | Ernst et al. | 60/616 |
| 2010/0114454 | A1 * | 5/2010 | French et al. | 701/102 |
| 2010/0175938 | A1 * | 7/2010 | Fassnacht et al. | 180/65.265 |

FOREIGN PATENT DOCUMENTS

| | | | |
|---|---|---|---|
| DE | 10047810 | A1 | 4/2002 |
| DE | 102004031365 | A1 | 1/2006 |
| EP | 0202344 | A1 | 11/1986 |
| EP | 0885758 | A2 | 12/1998 |
| EP | 1094214 | A2 | 4/2001 |
| FR | 2896531 | A1 | 7/2007 |
| GB | 2381576 | A | 5/2003 |
| JP | S58-158126 | | 10/1983 |
| JP | 60185011 | U | 12/1985 |
| JP | H02-26708 | | 2/1990 |
| JP | 2001 32 38 08 | A | 11/2001 |
| JP | 2001323808 | A | 11/2001 |
| JP | 2005 22 64 74 | A | 8/2005 |
| JP | 2005299592 | A | 10/2005 |

* cited by examiner

METHOD AND APPARATUS FOR OILING ROTATING OR OSCILLATING COMPONENTS

BACKGROUND AND SUMMARY

The invention concerns a method for heating a lubricating system of rotating or oscillating components, in particular for a combustion engine or a transmission, comprising at least one oil suction tube which is disposed inside an oil sump, and a bypass line which bypasses the oil return line, wherein a valve is disposed in the bypass line.

DE 27 53 716 concerns a heating device emitting hot air designed for motor vehicles powered by a combustion engine, comprising a heat exchanger which can be supplied with atmospheric air to transfer heat to a heat transfer medium flowing inside a pipe circuit, said pipe circuit having also a heat exchanger connected therein that absorbs exhaust gas heat from the combustion engine and transfers it to the heat transfer medium. The pipe circuit for the heat exchanger of the heating device is in heat-transferring connection with at least the lubricating oil circuit of the combustion engine. In this instance a heat transfer to the lubricating oil in a dry sump container is achieved in that the heat from a heat transfer medium flowing in a flow line is transferred to the lubricating oil in the dry sump container.

GB 2 381 576 A discloses an exhaust gas heat recovery device comprising a heat exchanger line and a bypass line. A heat exchanger is disposed in the vicinity of the heat exchanger line. At least one valve assembly is provided in the heat exchanger line and/or in the bypass line to influence the exhaust gas flow amount in the heat exchanger line. When installed, at least the heat exchanger line has a fall in an exhaust gas flow direction.

EP 0 885 758 B1 concerns a method for the operation of a heat exchanger in the exhaust gas flow of a combustion engine for motor vehicles, in which the exhaust gas flow can be split into a main line and a bypass line. The heat exchanger is disposed in the bypass line. In the warm-up phase, a back-pressure can be created in the main line, which causes a counter-pressure at the exhaust discharge port of the combustion engine. The warm-up phase is split into two phases, wherein in the first phase a higher counter-pressure is generated than in the second phase. A first valve is disposed in the main line between the bypass line connections, wherein a second valve is disposed in the bypass line downstream of the heat exchanger. Both valves are closed in the first phase, and in the second phase the first valve is closed but the second valve is open.

EP 0 202 344 describes an articulated tanker truck for the transport of liquid goods, wherein a medium flowing along the outside of the tank transfers heat to the contents of the tank. The medium is a heat transfer oil that flows in the circuit through at least one heat exchanger, which is heated by the hot exhaust gases of the combustion engine of the articulated tanker truck. To reduce the toxic content of the exhaust gases a catalytic converter, through which the combustion gases flow, is deposed upstream of the heat exchanger.

DE 199 08 088 A1 refers to a combustion engine, in particular a Diesel combustion engine, for a motor vehicle, comprising a passenger room heating device, an exhaust line, a coolant line, which forms a cooling circuit together with a first pump, to which the combustion engine is connected, and an exhaust gas heat exchanger for transferring exhaust heat to a heating heat exchanger. The exhaust gas heat exchanger operates between the exhaust line and a line for the circulation medium, which forms a circulation circuit to which the heating heat exchanger is directly or indirectly connected.

However, DE 199 08 088 A1 also refers to a combustion engine, in particular a Diesel combustion engine, wherein the combustion engine is connected to a first bypass that branches off from the coolant line, wherein a first thermostat valve is disposed in said first bypass, which largely closes said bypass until a median coolant temperature is reached, and which opens above said coolant temperature. In a second bypass, which extends parallel to the first bypass, a second thermostat valve is disposed, which largely closes said second bypass above the median cooling [sic] temperature.

DE 100 47 810 A1 concerns a heating circuit with an auxiliary heating device for motor vehicles with a combustion engine, which is part of a separate bypass circuit that can be switched into the heating circuit via a changeover device. The exhaust system of the vehicle's engine is used as an auxiliary heating device, from which the exhaust gas heat is transferred to the heating circuit. If the heat requirement of the passenger room heating device fails to meet the exhaust heat supply, the exhaust heat supply can be increased by means of the engine. Nevertheless, DE 100 47 810 A1 also refers to a process for operating a heating circuit with an auxiliary heating device for motor vehicles with a combustion engine, which is designed as an exhaust gas heat exchanger through which the engine exhaust gas and the coolant flow. The engine operating parameters can be adjusted to increase the heating performance of the auxiliary heating device.

EP 1 094 214 A2 refers to a heat recovery device comprising a circulation line in which a heat transfer medium circulates through an engine cooling unit, and an exhaust heat exchanger to utilise an engine's exhaust gases, and a line that connects a discharge side of the circulation line with an discharge port of the heat exchanger. The exhaust heat exchanger is disposed transversely through the circulation line on a side upstream of the engine cooling unit. The heat transfer medium introduced into the exhaust heat exchanger is adjusted to a lower temperature that is sufficient to lower the temperature of the water vapour contained in the exhaust gas stream from which heat is transferred to the heat transfer medium to lower its dew point.

When conducting an NEDC test (New European Driving Cycle) on a combustion engine in its cold state (starting temperature approx. 24° C.) the fuel consumption is approximately 10 to 15% higher than in the same test in which the engine oil temperature is approximately 90° C. when starting, which is the so-called NEDC hot test. The reason for this is, amongst others, that the lubricating oil has a higher viscosity at lower temperatures, and that the fuel condenses on the cylinder walls and finds its way into the engine oil. Moreover, measures are introduced to heat up the catalytic converter more quickly, for example though retarding the ignition, raising the idle speed and enrichment through secondary air injection. Furthermore, the majority of the exhaust emissions occur during the cold start phase of the combustion engine when the catalytic converter has not yet reached the required operating temperature. At the same time the majority of the energy supplied is discharged unused as exhaust gas enthalpy. This makes up in total approximately 30 to 40% of the energy of the supplied fuel.

It is known to improve the warm-up phase of the engine by employing exhaust heat exchangers that use a complex way of heating up the engine oil and reducing the oil pressure. On the other hand, this poses the problem of how to protect the engine, and in particular the engine oil, from overheating in this heating process. This is the reason why additional high capacity oil coolers are used. The known solutions are very elaborate and result only in a small reduction in the fuel consumption, hence a practical implementation hardly ever takes place for economic reasons.

FR 2 896 531 A1 discloses a method for speeding up the heating of a lubrication system of rotating components for a combustion engine. It comprises an oil suction tube disposed in an oil sump as well as a bypass line that bypasses the oil return lines. A valve is disposed in the oil bypass line with which the bypass line and/or at least one of the oil return lines can be connected to the suction pipe of an oil pump and the pressure line of a lubricating system. The routing chosen for the oil bypass line is not advantageous for raising the temperature more quickly.

It is desirable to improve a combustion engine or a transmission, in particular an automatic transmission of the kind described at the beginning using simple means so that the engine oil is heated up more quickly to reach the operating temperature in the cold-start phase or the warm-up phase respectively to achieve not only reduced fuel consumption but also a reduced emission of pollutants, wherein overheating of the engine oil is supposed to be prevented.

According to an aspect of the invention, an oil bypass line, which bypasses the oil return line, is connected to the suction line of an oil pump and to the pressure line of a lubricating system, wherein the oil bypass line, in the instance of a combustion engine, preferably extends through at least one cylinder head and/or one cylinder block and/or at least one turbo charger, and in the instance of a transmission, it preferably extends through at least one heat exchanger of the combustion engine and/or through at least one heating rod. Moreover, when dropping below a certain temperature limit and when exceeding a certain minimum pressure of the lubricating oil, in the pressure line of the lubricating system a bypass valve in the oil bypass line is at least partially opened so that a partial flow of the lubricating oil does not flow through the oil sump during a warm-up phase of the lubricating system until either the minimum pressure or the temperature limit are reached.

By feeding the lubricating oil directly back to the oil pump, the oil in the lubricating system heats up more quickly. Moreover, the pressure loss of the lubricating system to be overcome is reduced since the oil flowing back through the bypass line does not flow through the oil sump. Since preferably the oil of the bypass line is conducted through the cylinder block and/or the cylinder head, an increased oil volume flow can be achieved at lower temperatures by at least partially opening the bypass valve, which may be disposed on the cylinder head or the cylinder block. Thus, the oil is able to absorb more heat.

Reduced friction is achieved in the warm-up phase through this measure, since the lubricating oil is brought more quickly up to the operating temperature, and pressure losses are reduced.

The method for heating the lubricating system according to an aspect of the invention can be employed advantageously not only in motor vehicles with automatic transmissions but also in motor vehicles with manual transmissions, and can be used for the lubrication of the combustion engine as well as the transmission. In hybrid vehicles, which comprise a combustion engine as well as an electric drive, this heating method can be used to heat up the motor/generator unit more quickly, which achieve their optimal efficiency only at higher temperatures, and it can also lubricate the components that are driven by the electric motor. In these instances, it is advantageous to utilise the waste heat of the electric energy storage unit (battery) and/or the inverter to heat up the oil in the bypass line, which then heat up the motor/generator unit and may provide better lubrication for said motor/generator unit and a downstream transmission. As with combustion engines, an oil bypass line may also be disposed in automatic transmissions, comprising a heat exchanger through which additional heat is introduced into the transmission oil in the warm-up phase to reduce friction.

The invention can be applied to all types of plants and vehicles powered by combustion engines, such as passenger vehicles, trucks, buses, motorcycles, construction plants, ships, boats, aeroplanes as well as mobile and stationary equipment and devices, energy generating plants, such as emergency generators and similar. In particular in short-term use and under varying workloads the invention enables optimal lubrication to reduce friction between the moving parts so that the longevity of the machine can be increased, the noise level can be reduced, higher efficiency can be achieved, greater power output can be gained, a reduced level of exhaust gases is emitted and costs can be reduced.

Within the framework of the invention it is advantageous if the length of the oil line of the lubricating system from the discharge port of the oil pump up to the joining of the oil bypass line makes up at least 80% of the maximum length of the oil line of the lubricating system from the discharge port of the oil pump to the most distant device to be lubricated. This allows the lubricating oil flowing through the oil bypass line to heat up more quickly. In this context, it is of particular advantage if the lubricating oil mass flow through the oil bypass line is at least sometimes greater than the lubricating oil mass flow through the oil suction pipe and the oil sump. In this instance, the total math flow through the lubricating system is heated up more quickly than without oil bypass line.

Furthermore, it is also expedient if the oil bypass line is disposed inside the same housing in which also at least one of the devices to be lubricated is located so that the returning lubricating oil can be heated up even more. It is particularly advantageous if one or more oil return lines are connected directly to the suction pipe of an oil pump.

It is also advantageous within the meaning of the invention if the oil bypass line consists of or comprises a heat insulating material that has a thermal conductivity coefficient of less than 1 W/(m*K) to reduce the heat transfer to its surroundings during the return flow. This applies particularly to locations where the oil bypass line is not routed through the device to be lubricated.

To further speed up the heating up of the oil and to further reduce the pressure loss of the lubricating system it is advantageous if at least one of the lubricating oil return lines disposed downstream of the devices to be lubricated is connected to the oil bypass line, wherein one of the lubricating oil return lines connected to the oil bypass line is part of an exhaust gas turbocharger.

Since varying lubricating oil pressures are required for different loads and numbers of revolutions to provide adequate lubrication and to prevent damage to the components to be lubricated. According to the invention it is advantageous if the bypass valve in the oil bypass line is closed as soon as a predetermined number of revolutions or speed or torque or force of the components to be lubricated exceeds a preset threshold value.

In an advantageous embodiment of the invention the lubricating oil flowing through the oil bypass line is heated up by a heat exchanger. To accelerate the heating up of the lubricating oil even further it is advantageous if the heat exchanger for heating up the lubricating oil is subjected to the exhaust gas of a combustion engine downstream of a catalytic converter. Here, the exhaust gas flowing through the heat exchanger flows upstream through a valve. This valve is closed as soon as a preset temperature limit of the exhaust gas is reached to prevent coking of the lubricating oil in the heat exchanger.

In order to reduce the combustion temperature and thus also the nitrogen oxide emissions of the combustion engine, the exhaust gas flowing through the heat exchanger within the meaning of the invention advantageously flows as an exhaust gas return downstream through a valve into the intake manifold of a combustion engine, wherein the valve is at least partially closed as soon as a preset exhaust gas temperature limit is reached or as soon as a preset volume flow of the exhaust gas return is reached. During this process, the exhaust gas is cooled off by the heat exchanger, which causes a further reduction in combustion temperature. Hence no additional cooler for the exhaust gas return is required.

According to the invention it is expedient if the exhaust gas of the combustion engine, which flows parallel to the heat exchanger, flows through a further valve and that this valve is sometimes at least partially closed to increase the exhaust gas flow and thus also the heat exchange in the heat exchanger.

In a further advantageous embodiment of the invention a further heat exchanger and a further valve are disposed downstream of the oil pump for cooling, wherein said valve is at least partially opened if a preset threshold value for the lubricating oil temperature is exceeded or underrun. To achieve this, one embodiment uses a cooling medium, such as ambient air or a coolant, flowing through the heat exchanger to cool the lubricating oil. In another embodiment exhaust gas from the combustion engine flows through the heat exchanger to heat up the lubricating oil and reduce friction. It is advantageous if a further valve is disposed in the lubricating oil line parallel to the heat exchanger and the valve. This valve is at least partially closed if a preset threshold value for the lubricating oil temperature is either exceeded or underrun. It is also expedient if this heat exchanger is disposed in the passenger room heating circuit or in the circuit for heating or cooling of an electric battery.

According to the invention it is advantageous for controlling oil pressure and oil temperature if a control unit regulates the opening cross-section of the various valves, and if sensors for detecting lubricating oil pressure, lubricating oil temperature, exhaust gas temperature, number of rotations, load and/or coolant temperature are connected to the control unit.

In an advantageous embodiment of the invention the lubricating system, the exhaust gas line and the intake manifold are part of a combustion engine.

According to the invention it is also advantageous if at least one part of the lubricating system is disposed in a transmission, which is connected to the combustion engine, and if the combustion engine and the transmission are part of the motor vehicle. Here, it is particularly advantageous if the exhaust gas heat exchanger is a double-pipe unit so that the transmission oil and the engine oil can simultaneously be heated up, and that the exhaust gas heat exchanger is connected to the exhaust gas line through a heat-insulating material that has a thermal conductivity coefficient of less than 1 W(m*K).

The sealing of the valves in the exhaust gas line is of particular importance, since a tight seal not only increases the heating effectiveness but also prevents, in the closed position, that the oil is heated up unintentionally, for example at high engine loads and high numbers of rotation (rpm). This makes the application of an additional oil cooler redundant. According to the invention it is thus advantageous if the valves in the exhaust gas line are designed as a single-piece three-way valve and that said valves take the form of double-sided acting poppet valves, wherein the poppet has two sealing surfaces. One of the sealing surfaces is disposed at the outer end of the valve, like on an exhaust valve in the cylinder head of a combustion engine. The second sealing surface is disposed on the opposite side of the poppet, the side from which the valve stem extends to the actuating device. In its activated state, the outer end of the valve shuts off the exhaust bypass, and in the deactivated state, the inner sealing surface of the poppet shuts off the line to the heat exchanger.

BRIEF DESCRIPTION OF THE DRAWINGS

Further advantageous embodiments are disclosed in the sub-claims and in the following drawing description.

Wherein.

In the different Figures the same components are always depicted with the same reference numerals. Hence they are usually described only once.

DETAILED DESCRIPTION

Figure 1:
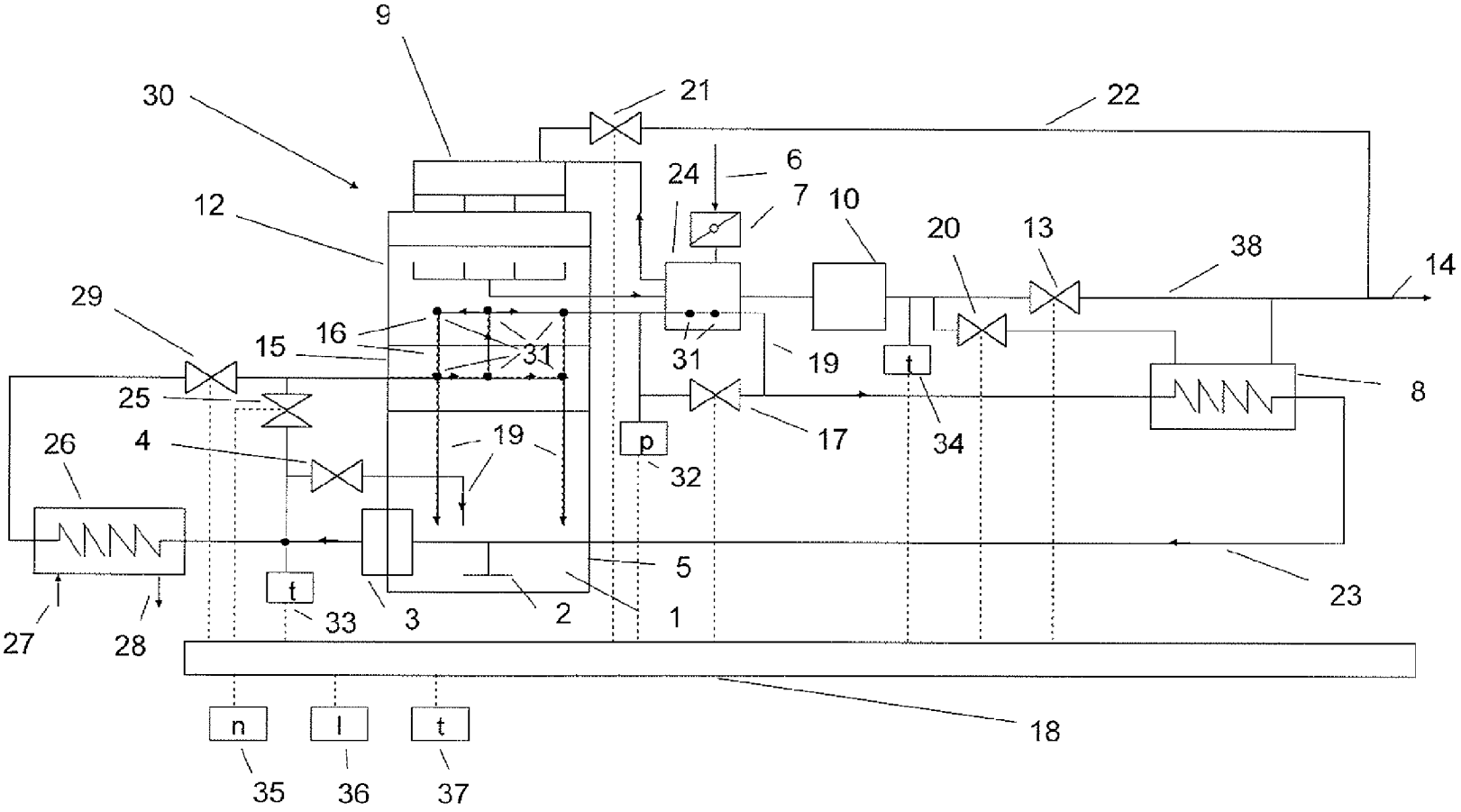
FIG. 1 shows a schematic of a first embodiment of the invention in a combustion engine.

FIG. 1 depicts a combustion engine 30 in a schematic representation. The combustion engine 30 comprises an exhaust line 14 in which a catalytic converter 10 is disposed. In the exemplary embodiment shown the combustion engine 30 is depicted as a four-cylinder engine whose four cylinder manifolds merge into a common exhaust gas line 14.

Seen in the exhaust gas flow direction of the exhaust gas, a heat exchanger 8 is disposed in the exhaust gas line 14 downstream of the catalytic converter 10, and a turbocharger 24 is disposed upstream of the catalytic converter. The combustion engine 30 comprises a lubricating oil system 16. The lubricating oil system comprises an oil sump 1, an oil suction tube 2, an oil pump 3, devices 31 to be lubricated of a cylinder head 12 and of a cylinder block 15 and of a turbocharger 24, oil pan 5, as well as an oil relief pressure valve 4.

Moreover, a bypass valve 17 is assigned to the lubricating oil system 16. The bypass valve 17 regulates the flow of the engine oil through the lubricating oil bypass 23 so that the temperature and the pressure of the engine oil can be adjusted to optimal values. The lubricating oil system 16 hence has multiple oil return lines 19.

An exhaust valve or an Exhaust Gas Recirculation valve 20, 21, 41, preferably an EGR control valve, is disposed in front of the heat exchanger 8 at least upstream of the exhaust gas stream, wherein said EGR control valve controls the exhaust gas flow through the heat exchanger 8 and thus also indirectly controls the oil temperature. The heat exchanger 8 is integrated into the lubricating oil system 16 so that the oil is heated up through the exhaust gas heat during a warm-up phase of the combustion engine 30. As an alternative to the heat exchanger 8 it is possible to use one or more electric heating elements, in particular heating rods, which also serve the purpose of heating up the oil inside the bypass line. Particularly in the instance of an automatic transmission it is an obvious choice to use an exhaust/oil heat exchanger to heat up the oil inside the bypass line.

In the exemplary embodiment shown an additional exhaust valve 13 is disposed in the exhaust gas line 14 parallel to heat exchanger 8, which regulates the exhaust gas flow through the exhaust gas bypass 38 which bypasses the heat exchanger 8.

A valve 29 and a heat exchanger 26 with a supply line 27 and a discharge line 28 is disposed in the lubricating oil system 16 downstream of the oil pump 3 for the purpose of controlling the oil temperature the and oil pressure. Moreover, in a further oil bypass line that bypasses the heat exchanger 26 a valve 25 is disposed for regulating the oil pressure and the oil temperature. The heat exchanger 26 can serve as an oil cooler to heat up the passenger room of a vehicle.

For the purpose of regulating the oil pressure and the oil temperature, a control unit 18 is connected to the valves 13, 17, 20, 21, 25, 29 and 41 as well as to Sensors for determining the lubricating oil pressure 32, the lubricating oil temperature 33, the exhaust gas temperature 34, the number of rotations 35, the load 36 and the coolant temperature 37.

A throttle 7, which is connected to a turbocharger 24 that feeds downstream into an intake manifold 9, is disposed in the intake system 6 of combustion engine 30. For the purpose of reducing the combustion temperature, the intake manifold is connected to the exhaust gas line 14 to the exhaust gas return line via an exhaust gas reticulation valve 21, which may be an EGR control valve, wherein the connection is disposed downstream of heat exchanger 8. In this instance, the heat exchanger 8 may be an EGR heat exchanger. This reduces the level of toxic nitrogen oxide emissions.

Through the advantageous embodiment shown in FIG. 1 the engine oil is heated up more quickly during a warm-up phase of the combustion engine 30. The exhaust gas bypass 38, which is controlled via the second exhaust gas valve 13, is routed parallel to the heat exchanger 8 so that an overheating of the engine oil in the heat exchanger is avoided. The heat exchanger 8 is preferably a counter-current flow type that dimensioned so that the engine oil is heated up as quickly as possible, while the exhaust gas is cooled down as much as possible.

Figure 2:
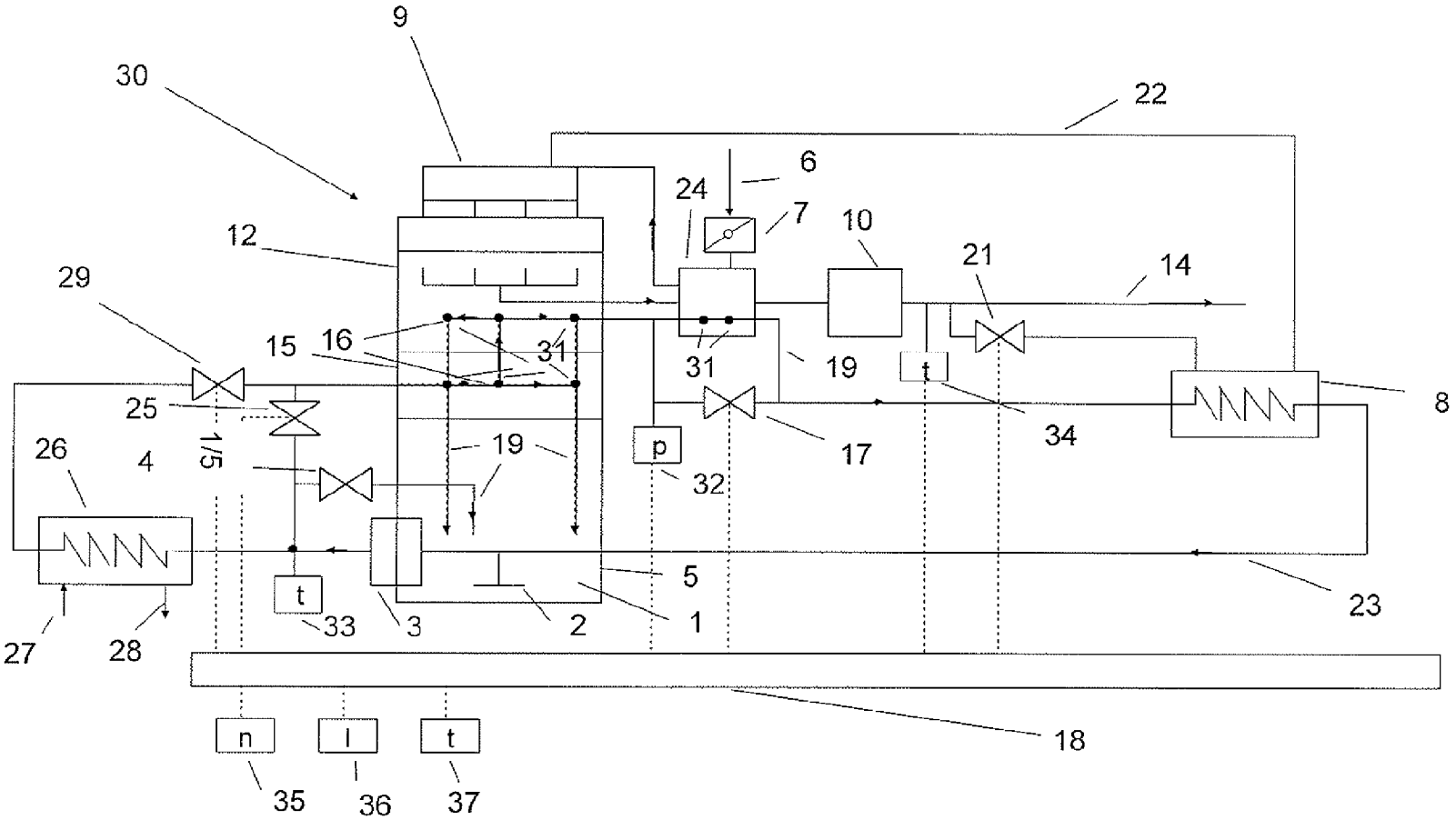
FIG. 2 shows a schematic of a second embodiment of the invention in a combustion engine.

FIG. 2 depicts an advantageous embodiment of the invention. In contrast to FIG. 1, the exhaust gas discharge of heat exchanger 8 is only connected to the intake manifold 9 so that the exhaust gas valve 13 and the exhaust gas recirculation valve 20 become redundant.

The heat exchanger in this advantageous embodiment of the invention has two functions. On the one hand the heat exchanger 8 heats up the engine oil through the exhaust gas temperature during the warm-up phase to avoid high combustion temperatures. On the other hand the heat exchanger 8 acts as a cooler for the exhaust gas recirculation 22 in that the exhaust gas that is returned into the intake manifold 9 is cooled by the lubricating oil. This makes an additional cooler for the exhaust gas recirculation and any additional valves for controlling the exhaust gas volume flow redundant.

Figure 3:
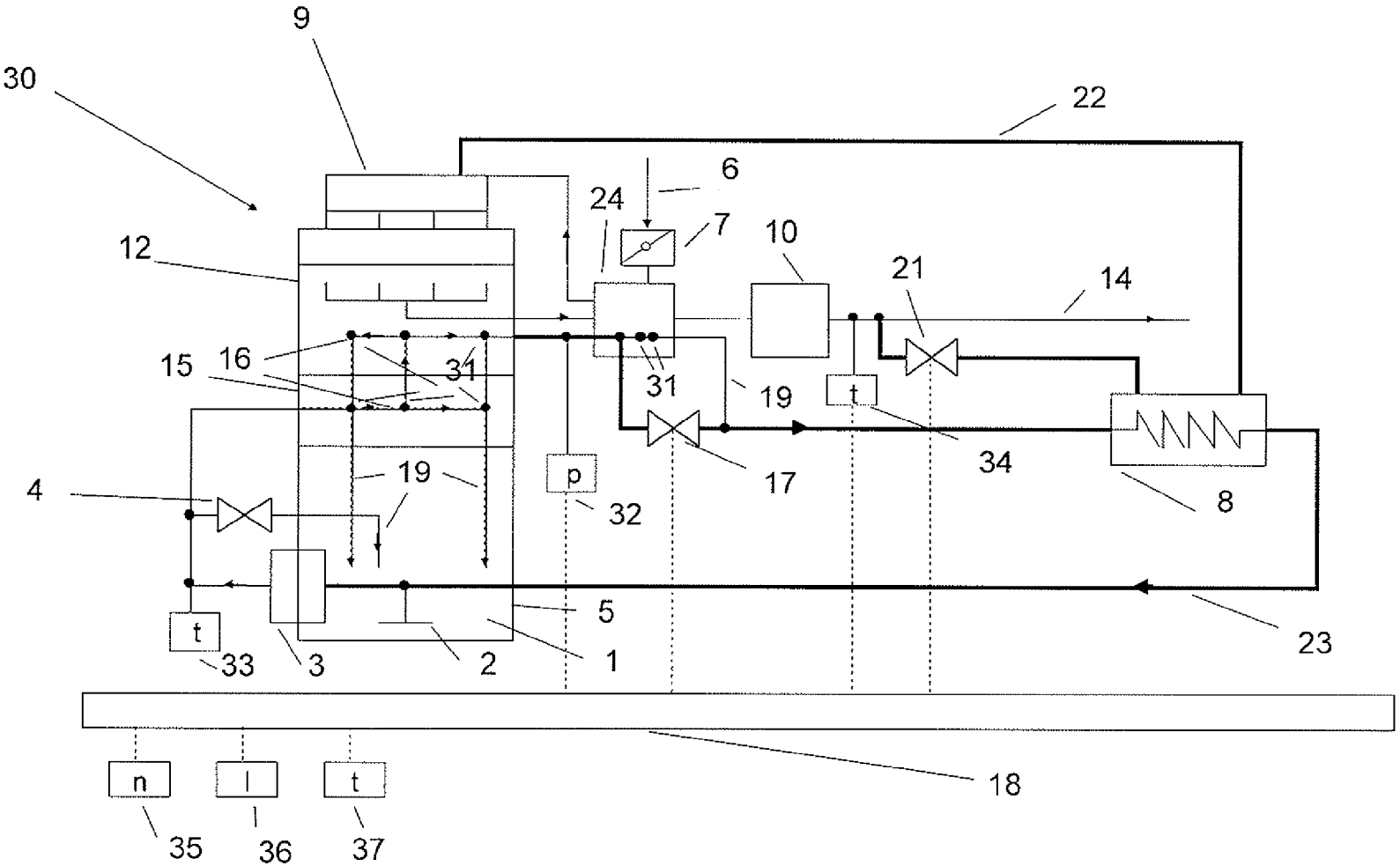
FIG. 3 shows a schematic of a further embodiment of the invention in a cold state.

FIG. 3 depicts an exemplary embodiment of an oil lubricating device in a cold state, for example shortly after starting a motor vehicle. The main oil flow through bypass valve 17 is shown in bold. The oil flows from the cylinder head 12 into the turbocharger 24. A bypass line leads from the turbocharger 24 to the open bypass valve 17, through which the oil continues to flow and joins up with the oil return line 19 from the turbocharger. From this location, the oil flows on through the heat exchanger 8 where it is heated up by the hot exhaust gas. The oil is then returned via the oil pan where the return line 23 is connected to the oil suction tube 2 so that the hot oil can be directly taken up by the oil pump 3.

The flow of the exhaust gas through the heat exchanger 8 is also shown in bold. The hot exhaust gas flows from the catalytic converter 10 into the exhaust gas line 14 and from there through the open exhaust gas recirculation valve 21 into the heat exchanger 28 where the cold oil is heated up and the exhaust gas is thereby cooled off. The cold exhaust gas flows from this location through the exhaust gas recirculation line 22 back to the intake manifold 9.

As soon as a certain threshold value for oil pressure is underrun, the oil bypass valve 17 is fully or at least partially closed so that the oil pressure in the combustion engine 30 can rise again.

Figure 4:
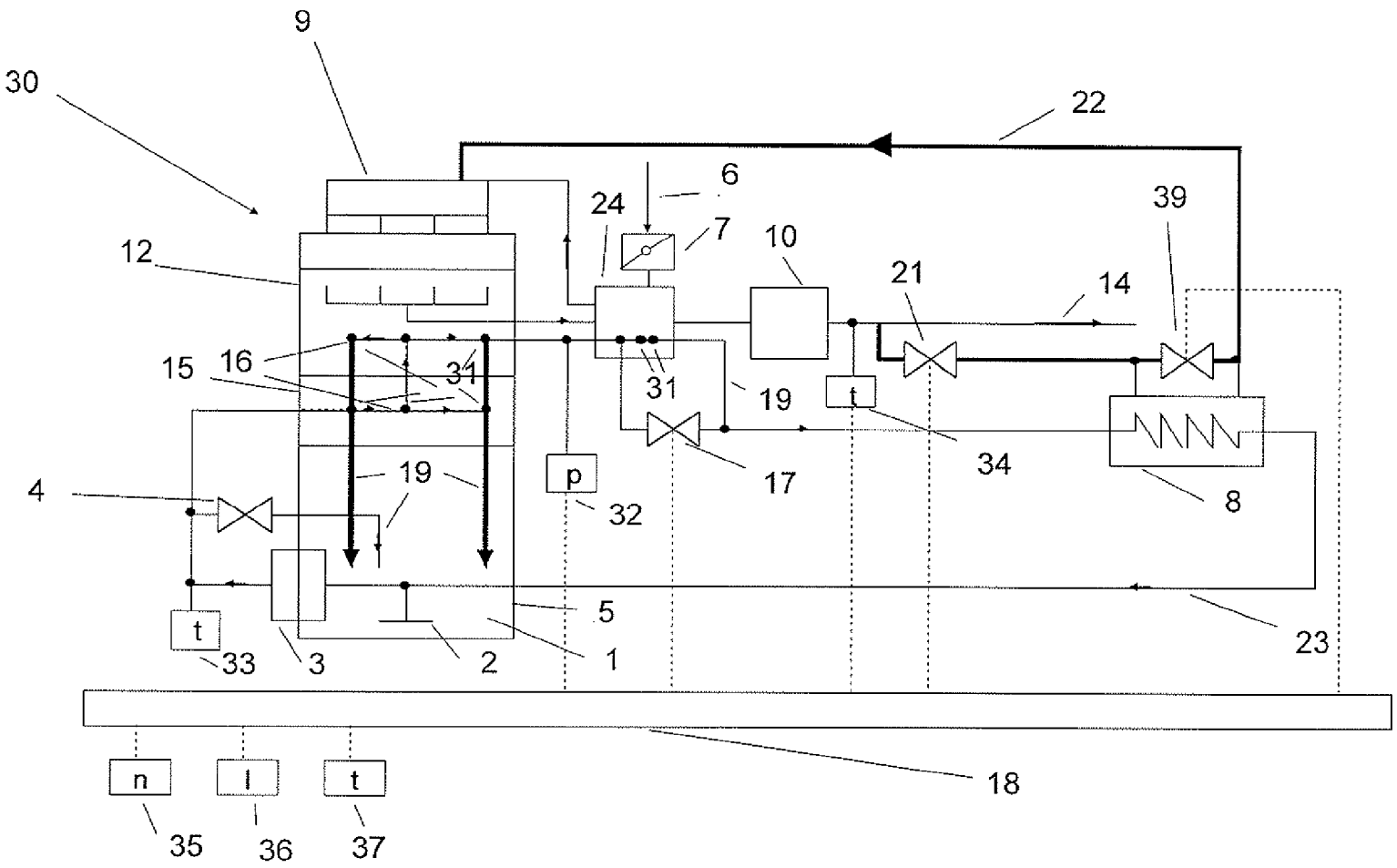
FIG. 4 shows a schematic of the embodiment of FIG. 3 in a hot state.

When exceeding a maximum oil temperature, the oil bypass valve 17 is fully or at least partially closed; the exhaust gas recirculation valve 21 is then also closed or, alternatively, the EGR bypass throttle shown in FIG. 4 is opened.

FIG. 4 shows the system in a simplified embodiment in a hot state. The bypass valve 17 is fully or at least partially closed so that only a very small oil volume flow passes through the heat exchanger 8. The majority of the lubricating oil—shown in bold here—then flows through the bearing points 31, for example main crank shaft bearing, big end bearing, camshaft bearing, piston lubrication holes, camshaft adjuster, cam follower etc. either through return lines 19 or directly back to the oil pan 1. The exhaust gas recirculation valve 21 may be either be closed or open. In the instance that the exhaust gas recirculation valve 21 is open, it is of advantage if the exhaust gas is returned via a further EGR bypass throttle 39 into the exhaust gas recirculation line 22 and the intake manifold 9.

Figure 5:
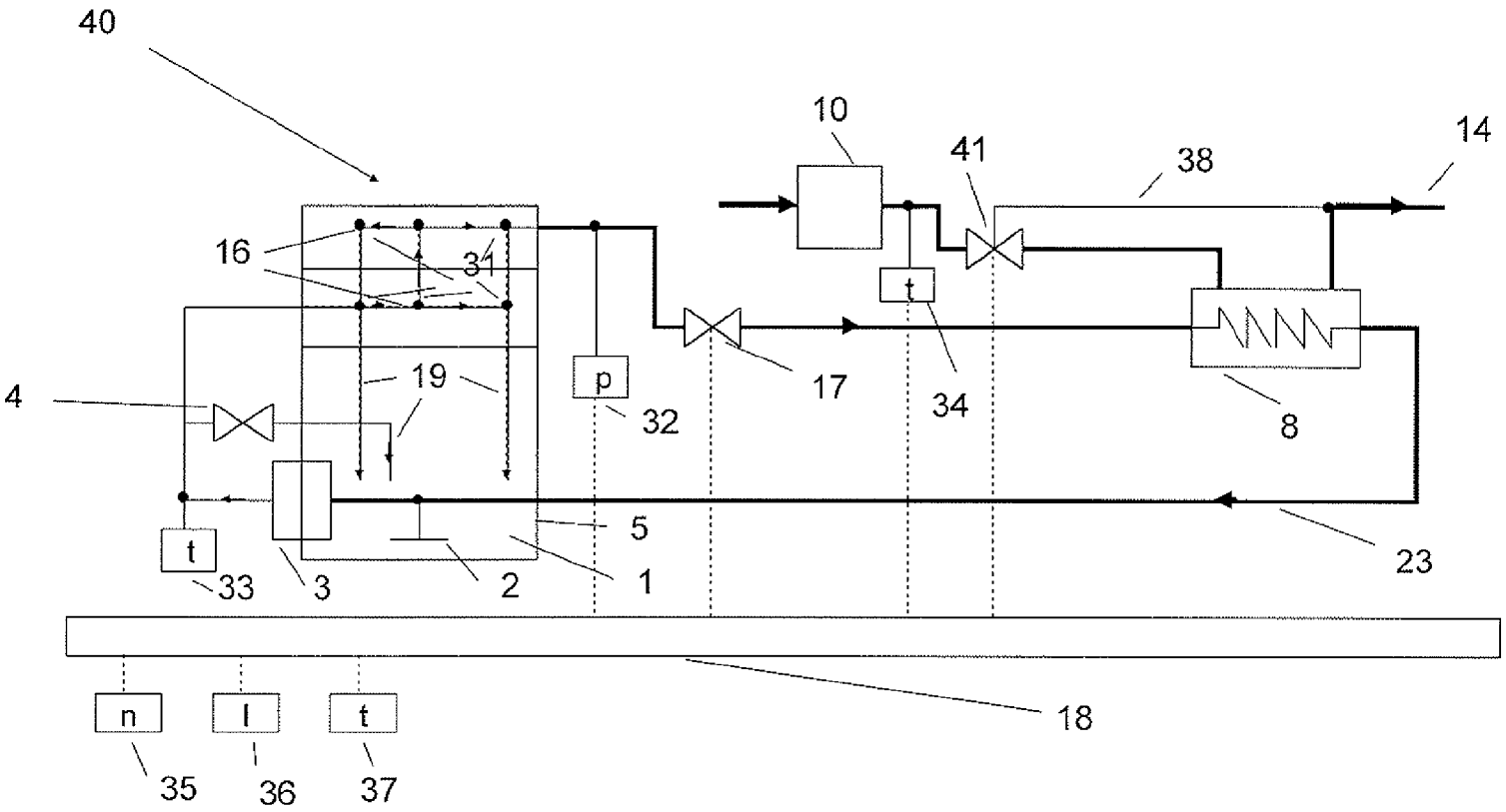
FIG. 5 shows a schematic of an embodiment of the invention in an automatic transmission.

FIG. 5 shows the system in combination with an automatic transmission 40. The exhaust gas flows from a combustion engine (not shown) through a catalytic converter 10 into a three-way valve 41. In the cold state, the exhaust gas flows through a heat exchanger 8 and heats up the transmission oil, which is released through a bypass valve 17. In the hot state, the exhaust gas does not flow through the heat exchanger 8 but through the bypass 38, and the bypass valve 17 is fully or at least partially closed.

As the oil pressure increases the volume flow of oil pump 3 drops more or less linearly, which occurs in particular at low oil temperatures. However, as the volume flow drops so does the heat transfer coefficient between oil and cylinder head 12 or cylinder block 15 respectively, so that the oil is able to absorb only little heat from the cylinder head 12 or the cylinder block 15 respectively. A relief valve 4 opens at very high pressures. This causes the oil volume flow through the cylinder head 12 and the cylinder block 15 to drop so that the mechanical pumping efficiency of the oil pump 3 is reduced. Thus, the heat transfer coefficient between oil and the metal of the cylinder block 15 or the cylinder head 12 respectively drops.

An increase of the heat transfer coefficient at low temperatures can be achieved by an embodiment of the invention in that the volume flow through the cylinder block 15 and particularly through the cylinder head 12 is increased at low temperatures. This is achieved by at least partially opening the (bypass) valve 17 depending on temperature, pressure, number of engine rotations and/or load. This purpose may be supported by increasing the volume output of the oil pump 3 by electrical means or by mechanical means through a gearing or through shifting of impeller wheels.

As further support it may be considered to let the oil flow through the oil gallery in the cylinder head 12 in series instead of in parallel, i.e. following the counter-current flow principle. To this effect it may be advantageous to let the oil first flow through a main gallery of a cylinder head 12, and then to let it flow back in the opposite direction at the discharge-sided end by way of a valve through a further main gallery of a cylinder head 12 so that the flow path of the oil through the cylinder head 12 is increased. Said valve may also be disposed at the other end of the bypass line 23 in the oil pan.

The oil that is present in the oil channels of a combustion engine 30 is only a fraction of the total oil volume, usually only 10%. In methods known from the state of the art, the entire oil volume is heated up evenly in the warm-up phase. The central idea of the invention is a targeted, rapid heating of the lubricating oil that is present in the oil channels. This is achieved by connecting the oil channel of the one or more cylinder heads 12 through a bypass line 23 to the suction side of the oil pump, wherein a vacuum is created at the end of the bypass line 23 to prevent the oil from flowing back into the oil pan 1 but rather to flow back into the oil channel. This means that, in the warm-up phase of the engine, only a small amount of the total oil quantity, which can be heated rapidly, is used for lubrication.

The vacuum at the end of the bypass line 23 can be created either through directly connecting the bypass line 23 to the suction side of the oil pump 3 or through a direct connection to the oil suction pipe 2. To this end, the bypass line 23 may be at least partly integrated into a synthetic oil pan with an integrated oil suction line 2, which results in improved insulation and reduced heat loss. Moreover, the end of the bypass line 23 in the oil sump I can be positioned in the immediate vicinity of the opening of the oil suction tube 2 so that the opening of the bypass line end points in the direction of the opening of the oil suction tube 2, forming with it an angle between 0° and 45°. This arrangement provides for easy installation as well as the option of retrofitting.

To improve the heat transfer of the oil in the cylinder head it is also conceivable to employ finned bodies in the oil galleries, for example through providing a rough surface of the oil channels in the cylinder block 15 or the cylinder head 12, in particular through incorporating a thread, thereby achieving a reduction in the oil quantity that can flow through.

In addition, it is possible to incorporate additional active heat sources in the bypass line 23, for example electric heating rods or heating elements, preferably one or more PTC heating rods, EGR oil coolers (exhaust gas recirculation coolers), full flow coolers or similar in order to heat up the oil in the oil channels quickly during the warm-up phase.

Furthermore, it is also conceivable to route the exhaust gas line 14 via a further valve, at least in the warm-up phase, directly through or adjacent to the oil sump 1 or into the bypass line 23. This would increase the heat transfer many times and a heat exchanger 8, where appropriate, may be redundant.

Moreover, through an engine control in the warm-up phase at least a small part of the exhaust gas flow may firstly be regulated in a targeted fashion through the heat exchanger 8 for heating up the oil in the bypass line 23, and after a certain time, the oil flow through the bypass line 23 can be shut off to prevent coking in exhaust gas heat exchanger 8. A higher priority control reference variable may be the required oil pressure as a function of the number of rotations and load, and a lower priority may be the desired oil temperature.

It is also conceivable to utilise the height potential differential between the cylinder head 12 and the oil suction line 2 to improve the flow characteristics in the bypass line 23 or, respectively, to design the height potential differential as large as possible.

Moreover, it may also be advantageous to use a thermal insulation for the bypass line 23 and/or for the EGR bypass (exhaust gas recirculation) at the exhaust gas side upstream of the valve 17, through using a ceramic tube so that the temperature of the exhaust gas heat exchanger 8 and the exhaust gas recirculation valve 21 is limited when the exhaust gas recirculation valve 21 is closed.

An oil collection pan with a tube may preferably be integrated in front of the oil suction tube 2 into an oil pan (not shown) of the oil sump 1 for the purpose of collecting the oil that returns from the bearings in the cylinder head and the crankshaft, and thereby is also heated up, and to feed it back directly to the oil pump without heating up the oil sump. In this instance, the valve 17 may also be integrated in the oil pan after combining the bypass line 23 and the tube of the oil collection pan, wherein a non-return valve must be placed into the tube of the oil collection pan so that the oil from the bypass line 23 cannot flow back into the oil collection pan.

A combination of the oil collection pan with lubricating nozzles may be advantageous, which are disposed in the conrod for cooling the pistons so that the oil volume flow is increased, wherein the lubricating nozzles remain switched on in the cold starting phase.

The exhaust gas flow for heating the oil in the bypass line 23 can be diverted from the exhaust gas flow as required. It would be particularly advantageous to divert the exhaust gas in front of a turbocharger by way of a commonly available EGR valve (exhaust gas recirculation valve) at a large distance from the turbocharger, wherein the high mass flow of the exhaust gas can be achieved at a small size and independent of the EGR calibration. Thus, the oil can be heated up without affecting the combustion temperature and the formation of the exhaust gas. With respect to the application of an exhaust gas recirculation it may be advantageous to lead condensed water into the exhaust provided that the EGR radiator arrangement conducts the gas vertically at an angle of up to 40 degrees of inclination to the vertical.

If the combustion engine 30 has neither a turbocharger nor an exhaust gas recirculation, an additional throttle in the main exhaust gas stream may create a pressure differential and thus can pass an increased volume flow through heat exchanger 8.

The invention is not limited to the exemplary embodiments shown. It is conceivable to connect the heat exchanger 26 to the exhaust line 14 to cause a more rapid heating of the lubricating oil. The arrangement of the valves may also vary, wherein the valves may be disposed downstream instead of upstream of the various heat exchangers, and also vice versa. The invention can be used for the lubrication of engine components, transmission components and other moving components of a vehicle.

The invention claimed is:

1. A method for heating a lubricating system of rotating or oscillating components for a combustion engine comprising at least one oil suction tube disposed in an oil sump, oil return lines for returning oil from the engine to the oil sump, an oil bypass line which bypasses the oil return lines, and a bypass valve disposed in the oil bypass line, comprising pumping oil through the bypass line via a pump in a pressure line, the bypass line being connected to a pressure line of the lubricating system downstream of at least some devices to be lubricated and to a suction tube of an oil pump, thus bypassing the oil return lines, routing the bypass line through at least one of a cylinder head and at least one turbocharger of the combustion engine, whereby oil is directed from the at least one of a cylinder head and at least one turbocharger downstream through the bypass line to enter the oil suction tube, and at least partially opening the bypass valve if a certain temperature limit is underrun and a certain minimum pressure is exceeded of the lubricating oil in the pressure line of the lubricating system to feed the lubricating oil directly back to the oil pump via the bypass line, so that at least a partial flow of the lubricating oil in a warm-up phase of the lubricating system does not flow through the oil sump until either the minimum pressure or the set temperature limit are reached.

2. A method according to claim 1, comprising closing the bypass valve as soon as at least one of a preset number of rotation value (rpm) or speed or torque or force of the components to be lubricated exceeds a preset threshold value and the output power of the oil pump is increased with respect to a preset number of rotation value, speed, torque or force to generate an increased pump volume flow within the oil line.

3. A method according to claim 1, comprising heating the lubricating oil flowing through the at least one of the oil bypass line and the at least one of the oil return lines by a heat exchanger.

4. A method according to claim 3, comprising heating the lubricating oil by flowing exhaust gas of the combustion engine through the heat exchanger, the exhaust gas flowing through the heat exchanger upstream through an exhaust valve/exhaust gas recirculation valve, closing the exhaust valve/exhaust gas recirculation valve as soon as a preset temperature limit of at least one of the exhaust gas and the lubricating oil is reached, and routing at least part of the exhaust gas through a controllable valve directly above or adjacent to the oil sump into or through an oil pan or into the bypass line to increase heat transfer.

5. A method according to claim 3, wherein the exhaust gas flowing through the heat exchanger flows through an exhaust gas recirculation valve and is connected downstream as an exhaust gas recirculation to the intake manifold of the combustion engine, the method comprising at least partially closing the exhaust gas recirculation valve as soon as at least one of a preset temperature limit of the exhaust has is reached and a preset volume flow of the exhaust gas recirculation is achieved.

6. A method according to claim 3, wherein the exhaust gas of the combustion engine flows parallel to the heat exchanger through second exhaust valve, the method comprising at least partially closing the second exhaust valve to increase the exhaust gas flow and thus heat transfer in the heat exchanger.

7. A method according to claim 1, wherein a second heat exchanger and a first valve are disposed downstream of the oil pump for cooling purposes, the method comprising at least partially opening the first valve if at least one of a preset lubricating oil temperature limit is exceeded or underrun and if a preset threshold value for the coolant intake temperature or the coolant discharge temperature is underrun, and wherein a second valve is disposed in the lubricating oil line parallel to the heat exchanger and the first valve, the method comprising at least partially closing, the second valve if a preset lubricating oil temperature limit is one of exceeded and underrun.

8. An apparatus for heating a lubricating system of rotating, or oscillating components for a combustion engine , comprising at least one oil suction tube disposed in an oil sump, oil return lines for returning oil from the combustion engine to the oil sump, an oil bypass line which bypasses the oil return lines, a bypass valve disposed in the oil bypass line, wherein the oil bypass line is connected to the pressure line of a lubricating system downstream of at least some devices to be lubricated and to a suction tube of an oil pump in the pressure line arranged to pump the oil through the bypass line, thus bypassing the oil return lines, wherein the oil bypass line is routed through at least one of at least one cylinder head and at least one turbocharger of the combustion engine, whereby oil is directed from the at least one cylinder head and at least one turbocharger downstream through the bypass line to enter the oil suction tube, and at least a partial flow of the lubricating oil in a warm-up phase of the lubricating system is fed directly back to the oil pump via the bypass line and does not flow through the oil sump until either a set oil pressure limit or a set oil temperature limit is reached.

9. An apparatus according to claim 8, wherein a length of an oil line of the lubricating system from a discharge of the oil pump up to a point at which the oil line joins the oil bypass line is at least 80% of a full length of the oil line of the lubricating system from the discharge port of the oil pump to a most distant device to be lubricated.

10. An apparatus according to claim 8, wherein the at least one of the oil bypass line and the at least one of the oil return lines is connected to the heat exchanger, the heat exchanger being disposed downstream behind a catalytic converter in an exhaust gas system of the combustion engine, and an exhaust valve/exhaust gas recirculation valve is disposed upstream of the heat exchanger, the exhaust valve/exhaust gas recirculation valve being adapted to change flow of the exhaust gas as a function at least of at least one of the oil temperature and the exhaust gas temperature, wherein an exhaust gas recirculation valve is disposed downstream of the heat exchanger, the exhaust gas recirculation valve being, connected downstream of the intake manifold of the combustion engine.

11. An apparatus according to claim 10, wherein an exhaust gas valve is disposed in an exhaust gas bypass line that extends parallel to the heat exchanger and bypasses it, in order to at least sometimes increase the exhaust gas flow and thus also heat transfer in the heat exchanger.

12. An apparatus according to claim 10, wherein the heat exchanger is disposed inside an exhaust gas line and is connected to the exhaust gas line by a thermally insulating material that has a thermal conductivity coefficient of less than 1 W/(m*K), and the heat exchanger is of the double-pipe type and is connected to at least one of the lubricating system of a combustion engine and the lubricating system of a transmission, and the combustion engine is part of a motor vehicle.

13. An apparatus according to claim 8, wherein the oil bypass line is disposed in a same housing in which at least one of the devices to be lubricated is disposed, wherein the oil bypass line is routed through at least one of the cylinder block, at least one cylinder head, and at least one turbocharger, and a further part of the oil bypass line is integrated into and forms a single piece with the oil pan, in which an end of the oil bypass line is disposed and points in a direction of an opening of the oil suction tube, the end of the oil bypass line and the opening of the oil suction tube forming an angle between 0° and 45° to each other.

14. An apparatus according to claim 8, wherein at least one of the lubricating oil return lines is disposed downstream of the devices to be lubricated and is connected to the oil bypass line, and at least one of the lubricating oil return lines being connected to the oil bypass line is part of an exhaust gas turbocharger.

15. An apparatus according to claim 8, comprising coolant lines, at least one of the coolant lines being a supply and a discharge line of a second heat exchanger disposed downstream of the oil pump, wherein at least one of the coolant lines is connected to the second heat exchanger for at least one of a passenger room heating and for a battery heating and cooling.

16. A method for heating a lubricating system of rotating or oscillating components for a transmission of a combustion engine comprising at least one oil suction tube disposed in an oil sump, oil return lines for returning oil from the transmission to the oil sump, an oil bypass line which bypasses the oil return lines, and a bypass valve disposed in the oil bypass line, comprising pumping oil through the bypass line via a pump in a pressure line, the bypass line being connected to a pressure line of the lubricating system downstream of at least some devices to be lubricated and to a suction tube of an oil pump, thus bypassing the oil return lines, routing the bypass line through at least one of a heat exchanger of the combustion engine and at least one electric heating element so that oil is directed from the at least one of a heat exchanger of the combustion engine and the at least one electric beating element downstream through the bypass line to enter the oil suction tube, at least partially opening the bypass valve if a certain temperature limit is underrun and a certain minimum pressure is exceeded of the lubricating oil in the pressure line of the lubricating system to feed the lubricating oil directly back to the oil pump via the bypass line, so that at least a partial flow of the lubricating oil in a warm-up phase of the lubricating system does not flow through the oil sump until either the minimum pressure or the set temperature limit are reached.

17. A method according to claim 16, comprising closing the bypass valve as soon as at least one of a preset number of rotation value (rpm) or speed or torque or force of the components to be lubricated exceeds a preset threshold value and the output power of the oil pump is increased with respect to a preset number of rotation value, speed, torque or force to generate an increased pump volume flow within the oil line.

18. A method according to claim 16, comprising heating the lubricating oil flowing through the at least one of the oil bypass line and the at least one of the oil return lines by a heat exchanger.

19. A method according to claim 18, comprising heating the lubricating oil by flowing exhaust gas of the combustion engine through the heat exchanger, the exhaust gas flowing through the heat exchanger upstream through an exhaust valve/exhaust gas recirculation valve, dosing the exhaust valve/exhaust gas recirculation valve as soon as a preset temperature limit of at least one of the exhaust gas and the lubricating oil is reached, and routing at least part of the exhaust gas through a controllable valve directly above or adjacent to the oil sump into or through an oil pan or into the bypass line to increase heat transfer.

20. A method according to claim 18, wherein the exhaust gas flowing through the heat exchanger flows through an exhaust gas recirculation valve and is connected downstream as an exhaust gas recirculation to the intake manifold of the combustion engine, the method comprising at least partially closing the exhaust gas recirculation valve as soon as at least one of a preset temperature limit of the exhaust gas is reached and a preset volume flow of the exhaust gas recirculation is achieved.

21. A method according to claim 18, wherein the exhaust gas of the combustion engine flows parallel to the heat exchanger through second exhaust valve, the method comprising at least partially closing the second exhaust valve to increase the exhaust gas flow and thus heat transfer in the heat exchanger.

22. A method according to claim 16, wherein a second heat exchanger and a first valve are disposed downstream of the oil pump for cooling purposes, the method comprising at least partially opening the first valve if at least one of a preset lubricating oil temperature limit is exceeded or underrun and if a preset threshold value for the coolant intake temperature or the coolant discharge temperature is underrun, and wherein a second valve is disposed in the lubricating oil line parallel to the heat exchanger and the first valve, the method comprising at least partially closing the second valve if a preset lubricating oil temperature limit is one of exceeded and underrun.

23. An apparatus for heating a lubricating system of rotating or oscillating components for a transmission of a combustion engine, comprising at least one oil suction tube disposed in an oil sump, oil return lines for returning oil from the transmission to the oil sump, an oil bypass line which bypasses the oil return lines, a bypass valve disposed in the oil bypass line, wherein the oil bypass line is connected to the pressure line of a lubricating system downstream of at least some devices to be lubricated and to a suction tube of an oil pump in the pressure line arranged to pump the oil through the bypass line, thus bypassing the oil return lines, wherein the oil bypass line is routed through at least one of at least one beat exchanger of the combustion engine and at least one electric heating element so that oil is directed from the at least one of a heat exchanger of the combustion engine and the at least one electric heating element downstream through the bypass line to enter the oil suction tube, and at least a partial flow of the lubricating oil in a warm-up phase of the lubricating system is fed directly back to the oil pump via the bypass line and does not flow through the oil sump until either a set oil pressure limit or a set oil temperature limit is reached.

24. An apparatus according to claim 23, wherein a length of an oil line of the lubricating system from a discharge of the oil pump up to a point at which the oil line joins the oil bypass line is at least 80% of a full length of the oil line of the lubricating system from the discharge port of the oil pump to a most distant device to be lubricated.

25. An apparatus according to claim 23, wherein the at least one of the oil bypass line and the at least one of the oil return lines is connected to the heat exchanger, the heat exchanger being disposed downstream behind a catalytic converter in an exhaust has system of the combustion engine, and an exhaust valve/exhaust gas recirculation valve is disposed upstream of the heat exchanger, the exhaust valve/exhaust gas recirculation valve being adapted to change flow of the exhaust gas as a function at least of at least one of the oil temperature and the exhaust gas temperature, wherein an exhaust gas recirculation valve is disposed downstream of the heat exchanger, the exhaust recirculation valve being, connected downstream of the intake manifold of the combustion engine.

26. An apparatus according to claim 25, wherein an exhaust gas valve is disposed in an exhaust gas bypass line that extends parallel to the heat exchanger and bypasses it, in order to at least sometimes increase the exhaust gas flow and thus also heat transfer in the heat exchanger.

27. An apparatus according to claim 25, wherein the heat exchanger is disposed inside an exhaust gas line and is connected to the exhaust gas line by a thermally insulating material that has a thermal conductivity coefficient of less than 1 W/(m*K), and the heat exchanger is of the double-pipe type and is connected to at least one of the lubricating system of a combustion engine and the lubricating system of a transmission, and the combustion engine and the transmission are part of a motor vehicle.

28. An apparatus according to claim 23, wherein the oil bypass line is disposed in a same housing in which at least one of the devices to be lubricated is disposed, and a further part of the oil bypass line is integrated into and forms a single piece with the oil pan, in which an end of the oil bypass line is disposed and points in a direction of an opening of the oil suction tube, the end of the oil bypass line and the opening of the oil suction tube forming an angle between 0° and 45° to each other.

29. Ann apparatus according to claim 23, wherein at least one of the lubricating oil return lines is disposed downstream of the devices to be lubricated and is connected to the oil bypass line, and at least one of the lubricating oil return lines being connected to the oil bypass line is part of an exhaust gas turbocharger.

30. An apparatus according to claim 23, comprising coolant lines, at least one of the coolant lines being a supply and a discharge line of a second heat exchanger disposed downstream of the oil pump, wherein at least one of the coolant lines is connected to the second heat exchanger for at least one of a passenger room heating and for a battery heating and cooling.

* * * * *